US006363922B1

(12) United States Patent
Romzek et al.

(10) Patent No.: US 6,363,922 B1
(45) Date of Patent: Apr. 2, 2002

(54) EXHAUST GAS RECIRCULATION PRESSURE DIFFERENTIAL SENSOR ERROR COMPENSATION

(76) Inventors: Martin Anthony Romzek, 23028 Lodge La., Dearborn, MI (US) 48128; Richard Marcis, 40481 13 Mile Rd., Novi, MI (US) 48377

( * ) Notice: Subject to any disclaimer, the term of this patent is extended or adjusted under 35 U.S.C. 154(b) by 0 days.

(21) Appl. No.: 09/686,184

(22) Filed: Oct. 11, 2000

(51) Int. Cl.[7] ..... F02M 25/07
(52) U.S. Cl. ..... 123/568.16; 701/108; 73/117.3
(58) Field of Search ..... 123/568.11, 568.12, 123/568.16, 568.21; 73/116, 117.3, 118.1, 118.2; 701/101, 102, 103, 108

(56) References Cited

U.S. PATENT DOCUMENTS 5,190,017 A * 3/1993 Cullen et al. ..... 701/108
5,341,300 A * 8/1994 Fujimoto ..... 701/108
5,974,802 A 11/1999 Blake
6,000,222 A 12/1999 Regnier
6,003,315 A 12/1999 Bailey
6,026,790 A 2/2000 Itoyama
6,038,860 A 3/2000 Bailey
6,042,505 A 3/2000 Bellinger
6,055,811 A 5/2000 Maddock et al.
6,055,965 A 5/2000 Amstutz et al.
6,058,707 A 5/2000 Bischoff
6,062,204 A 5/2000 Cullen
6,067,800 A 5/2000 Kolmanovsky et al.
6,076,353 A 6/2000 Freudenberg et al.
6,079,395 A 6/2000 Coleman
6,095,127 A * 8/2000 Kolmanovsky et al. ..... 701/108
6,182,644 B1 * 2/2001 Kotwicki et al. ..... 123/568.16
6,293,267 B1 * 9/2001 Smith et al. ..... 701/108
6,308,694 B1 * 10/2001 Kotwicki et al. ..... 123/568.16

* cited by examiner

*Primary Examiner*—Willis R. Wolfe
(74) *Attorney, Agent, or Firm*—Brooks & Kushman P.C.

(57) ABSTRACT

The present invention involves a system and method of compensating sensor error of a differential pressure sensor on an exhaust gas recirculation passage for a calculation of a flow rate of recirculated exhaust gas into a vehicle engine. The method includes providing data representing default output of the differential pressure sensor based the coolant temperature of the engine and providing a predetermined threshold deviation of the default output. The method further includes determining the engine coolant temperature and an actual idle output of the sensor, when the engine is at an idle engine speed for a predetermined period of time, and calculating an actual error value of the sensor based on observing the actual idle output and engine coolant temperature. The method further includes utilizing the actual error of value of calculating the flow rate of the recirculated exhaust gas into the vehicle engine at off-idle conditions.

21 Claims, 4 Drawing Sheets

| COOLANT TEMPERATURE (°C) | @ 0 PSIG DEFAULT OFFSET (COUNTS) |
|---|---|
| 15.0 | 115.00 |
| 20.0 | 117.00 |
| 25.0 | 120.00 |

EXHAUST GAS RECIRCULATION PRESSURE DIFFERENTIAL SENSOR ERROR COMPENSATION

TECHNICAL FIELD

The present invention relates to systems and methods of compensating sensor error of a differential pressure sensor on an exhaust gas recirculation passage for a calculation of a flow rate of recirculated exhaust gas into a vehicle engine.

BACKGROUND ART

In compression-ignition engines, such as heavy-duty diesel engines, the intake air is typically cooled and compressed by using a turbo charger, to provide increased power density for the engine. Added flexibility in the compression of the intake air over a conventional turbo charger is often achieved by using a variable geometry turbo charger ("VGT") which may be controlled by the engine's electronic control module ("ECM") to supply varying amounts of turbo boost pressure to the engine, depending on various operating conditions. One system for controlling an engine having a VGT is disclosed in U.S. Pat. No. 6,000,221, issued to Church et al. on Dec. 14, 1999.

While designing engines to minimize the negative impact on engine fuel economy and durability, compression-ignition engine designers have also been challenged in designing engines to reduce $NO_x$ emissions. An engine is equipped with several sensors to allow the ECM to effectively reduce $NO_x$ emissions. However, sensors used in obtaining data to reduce $NO_x$ emissions typically include differing calibrations and error. As a result, the engine's ECM may perform non-optimally in reducing $NO_x$ emissions, due to such differences.

DISCLOSURE OF INVENTION

It is an object of the present invention to provide for an improved method of compensating sensor error of a differential pressure sensor of an exhaust gas recirculation passage for a calculation of a flow rate of recirculated exhaust gas into a vehicle engine. The method includes providing data representing default output of the differential pressure sensor based on the coolant temperature of the engine and providing a predetermined threshold deviation of the default output. The method further includes determining the engine coolant temperature and an actual idle output of the sensor, when the engine is at an idle engine speed for a predetermined period time, and calculating an actual error value of the sensor based on observing the actual idle output of engine coolant temperature. The method further includes utilizing the actual error value in calculating the flow of the recirculated exhaust gas into the vehicle at off-idle conditions.

In another embodiment of the present invention, the method further includes determining the engine coolant temperature and an actual number of key-on output of the sensor, upon ignition of the engine. The method further includes signaling a key-on fault code and applying the default output at the respective coolant temperature to a calculation of the flow rate of recirculated exhaust gas into the vehicle engine, if the actual number of key-on output is greater than a first sum. Further, the method comprises signaling an ignition fault code and applying the default output at the respective coolant temperature to the calculation of the flow rate of the circulated exhaust gas into the vehicle engine, if the actual number of idle output is greater than a second sum.

It is another object of the present invention to provide an improved system for compensating sensor error of a differential pressure sensor on an exhaust gas recirculation passage for use in a calculation of a flow rate of recirculated exhaust gas into a vehicle engine. The system comprising an exhaust gas re-circulating valve mounted in the engine exhaust line for controllably diverting a selected portion of the exhaust gas for mixture with intake error, a temperature sensor mounted in the flow path of the engine coolant, and an obstruction in the flow path of the re-circulating exhaust gas. The system further includes a differential pressure sensor including a first pressure tab located for sensing the pressure of the recirculated exhaust gas upstream of the obstruction, and a second pressure tab located for sensing the pressure of the recirculated exhaust gas downstream of the obstruction, wherein the differential pressure sensor has outputs indicative of current differential pressure across the obstruction. The system further includes control logic for determining flow rate of the recirculated exhaust gas, wherein the control logic has a list of default output of the differential pressure sensor based on the coolant temperature of the engine and has a predetermined threshold deviation of the default output of the differential pressure sensor.

It is yet another object of the present invention to provide for still another improved system for compensating sensor error of a differential pressure sensor on an exhaust gas recirculation passage for use in a calculation of a flow rate of recirculated exhaust gas into a vehicle engine. The system includes a mechanism for providing data representing default output of the differential pressure sensor based on the coolant temperature of the engine and providing a predetermined threshold deviation of the default output, a mechanism for determining the engine coolant temperature and an actual idle output of the sensor, when the engine is at an idle engine speed for a predetermined period of time. The system further includes a mechanism for calculating an actual error value of the sensor based on observing the actual idle output and engine coolant temperature, and a mechanism for utilizing the actual error value in calculating the flow rate of the recirculated exhaust gas into the vehicle engine at off-idle conditions.

BEST MODE FOR CARRYING OUT THE INVENTION

Figure 1:
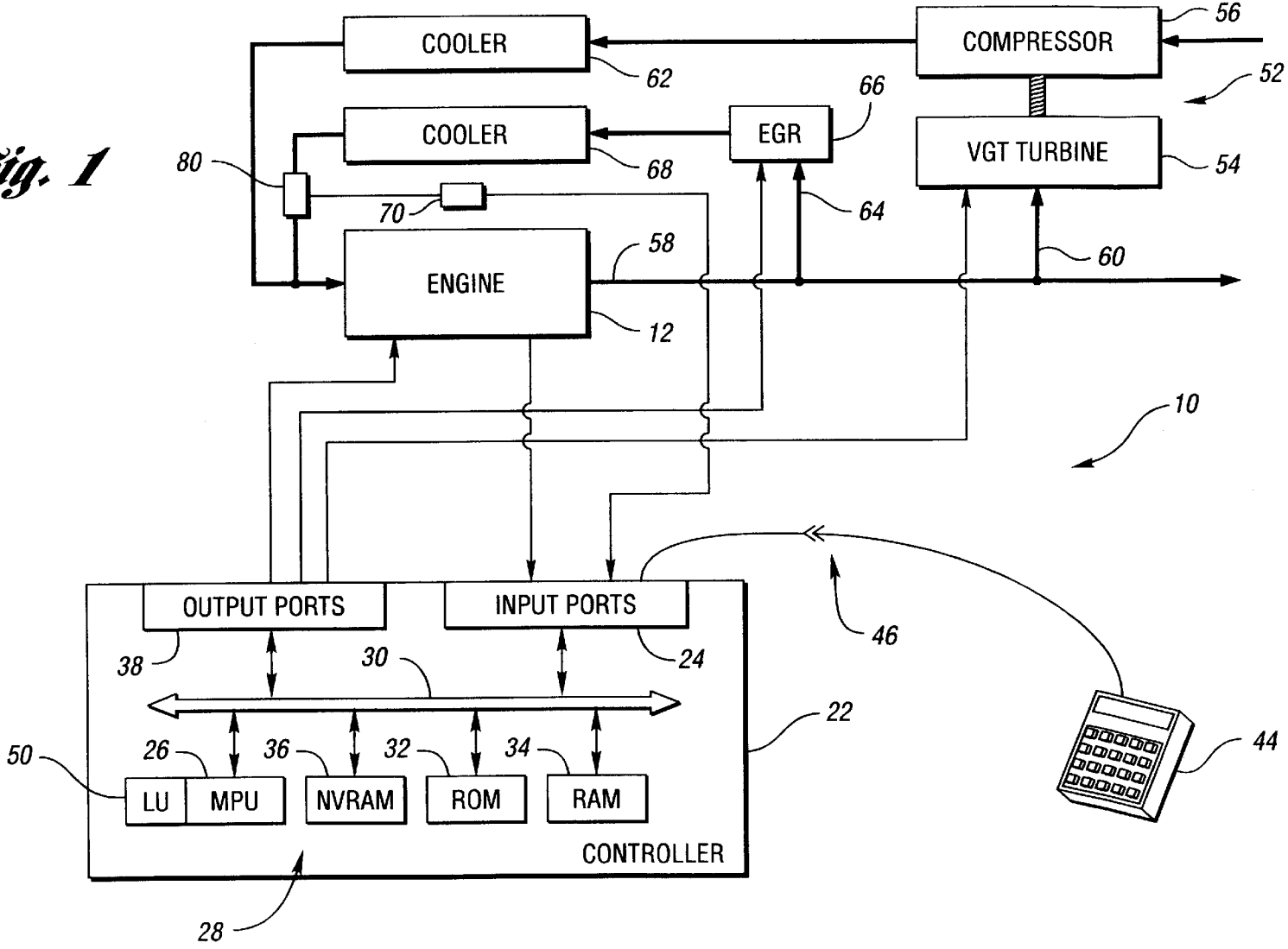
FIG. 1 is a schematic diagram of an internal combustion engine and engine control system made in accordance with an embodiment of the present invention.

With reference to FIG. 1, an internal combustion engine and associated control systems and subsystems are generally indicated at 10. System 10 includes an engine 12 having a plurality of cylinders (not shown), each fed by a fuel injector (not shown). In a preferred embodiment, engine 12 is a compression-ignition internal combustion engine, such as a heavy duty diesel fuel engine. The injectors receive pressurized fuel from a fuel supply in a known manner. Various sensors are in electrical communication with a controller 22 via input ports 24. Controller 22 preferably includes a microprocessor 26 in communication with various computer readable storage media 28 via data and control bus 30. Computer readable storage media 28 may include any of a number of known devices which function as read only memory 32, random access memory 34, and non-volatile random access memory 36.

Computer readable storage media 28 have instructions stored thereon that are executable by controller 22 to perform methods of controlling the internal combustion engine, including variable flow exhaust gas recirculation (EGR) valve 66 and variable geometry turbocharger 52. The program instructions direct controller 22 to control the various systems and subsystems of the vehicle, with the instructions being executed by microprocessor 26, and optionally, instructions may also be executed by any number of logic units 50. Input ports 24 receive signals from various sensors, and controller 22 generates signals at output ports 38 that are directed to the various vehicle components. A data, diagnostics, and programming interface 44 may also be selectively connected to controller 22 via a plug 46 to exchange various information there between. Interface 44 may be used to change values within the computer readable storage media 28, such as configuration settings, calibration variables, instructions for EGR and VGT control and others.

In operation, controller 22 receives signals from the various vehicle sensors and executes control logic embedded in hardware and/or software to control the engine. In a preferred embodiment, controller 22 is the DDEC controller available from Detroit Diesel Corporation of Detroit, Mich. Various other features of this controller are described in detail in U.S. Pat. Nos. 6,000,221; 5,477,827; and 5,445,128, the disclosure of which are hereby incorporated by reference.

As is appreciated by one of ordinary skill in the art, control logic may be implemented in hardware, firmware, software, or combinations thereof. Further, control logic may be executed by controller 22, in addition to by any of the various systems and subsystems of the vehicle cooperating with controller 22. Further, although in a preferred embodiment, controller 22 includes microprocessor 26, any of a number of known programming and processing techniques or strategy may be used to control an engine in accordance with the present invention. Further, it is to be appreciated that the engine controller may receive information in a variety of ways. For example, engine systems information could be received over a data link, at a digital input or at a sensor input of the engine controller.

With continuing reference to FIG. 1, controller 22 provides enhanced engine performance by controlling a variable flow exhaust gas recirculation valve 66 and by controlling a variable geometry turbocharger 52. Variable geometry turbocharger 52 includes a turbine 54 and a compressor 56. The pressure of the engine exhaust gasses causes the turbine to spin. The turbine drives the compressor, which is typically mounted on the same shaft. The spinning compressor creates turbo boost pressure which develops increased power during combustion.

A variable geometry turbocharger has moveable components in addition to the rotor group. These moveable components can change the turbocharger geometry by changing the area or areas in the turbine stage through which exhaust gasses from the engine flow, and/or changing the angle at which the exhaust gasses enter or leave the turbine. Depending upon the turbocharger geometry, the turbocharger supplies varying amounts of turbo boost pressure to the engine. The variable geometry turbocharger may be electronically controlled to vary the amount of turbo boost pressure based on various operating conditions. In a variable geometry turbocharger, the turbine housing is oversized for an engine, and the air flow is choked down to the desired level. There are several designs for the variable geometry turbocharger. In one design, a variable inlet nozzle has a cascade of moveable vanes which are pivotable to change the area and angle at which the air flow enters the turbine wheel. In another design, the turbocharger has a moveable side wall which varies the effective cross-sectional area of the turbine housing. It is appreciated that embodiments of the present invention are not limited to any particular structure for the variable geometry turbocharger. That is, the term VGT as used herein means any controllable air pressurizing device including the above examples, and including a modulated waste gate valve.

An exhaust gas recirculation system introduces a metered portion of the exhaust gasses into the intake manifold. The EGR system dilutes the incoming fuel charge and lowers combustion temperatures to reduce the level of oxides of nitrogen. The amount of exhaust gas to be recirculated is controlled by EGR valve 66 and VGT 52. In accordance with the present invention, the EGR valve is a variable flow valve that is electronically controlled by controller 22. The geometry of the variable geometry turbocharger is also electronically controlled by controller 22. It is appreciated that there are many possible configurations for a controllable EGR valve, and embodiments of the present invention are not limited to any particular structure for the EGR valve. Further, it is appreciated that various sensors at the EGR valve may detect temperature and/or differential pressure to allow the engine control to determine the mass flow rate through the valve. In addition, it is appreciated that various different sensor configurations may be utilized in various parts of the exhaust flow paths to allow controller 22 to determine the various mass flow rates throughout the exhaust system, including flow through the EGR system and flow through the compressor, and any other flows.

In some embodiments, it may be desirable to provide a cooler 62 to cool the charge air coming from compressor 56. Similarly, in some embodiments, it may be desirable to provide a cooler 68 to cool the flow through the EGR system prior to reintroduction to engine 12 of the gasses. Embodiments of the present invention include control logic that processes various inputs representing various engine conditions, and in turn, provides an EGR command signal and a VGT command signal. The EGR command signal commands a position for the variable flow EGR valve 66 to control gas flow through path 64, while the VGT command signal commands a geometry for VGT 52 to control gas flow through path 60.

Figure 2:
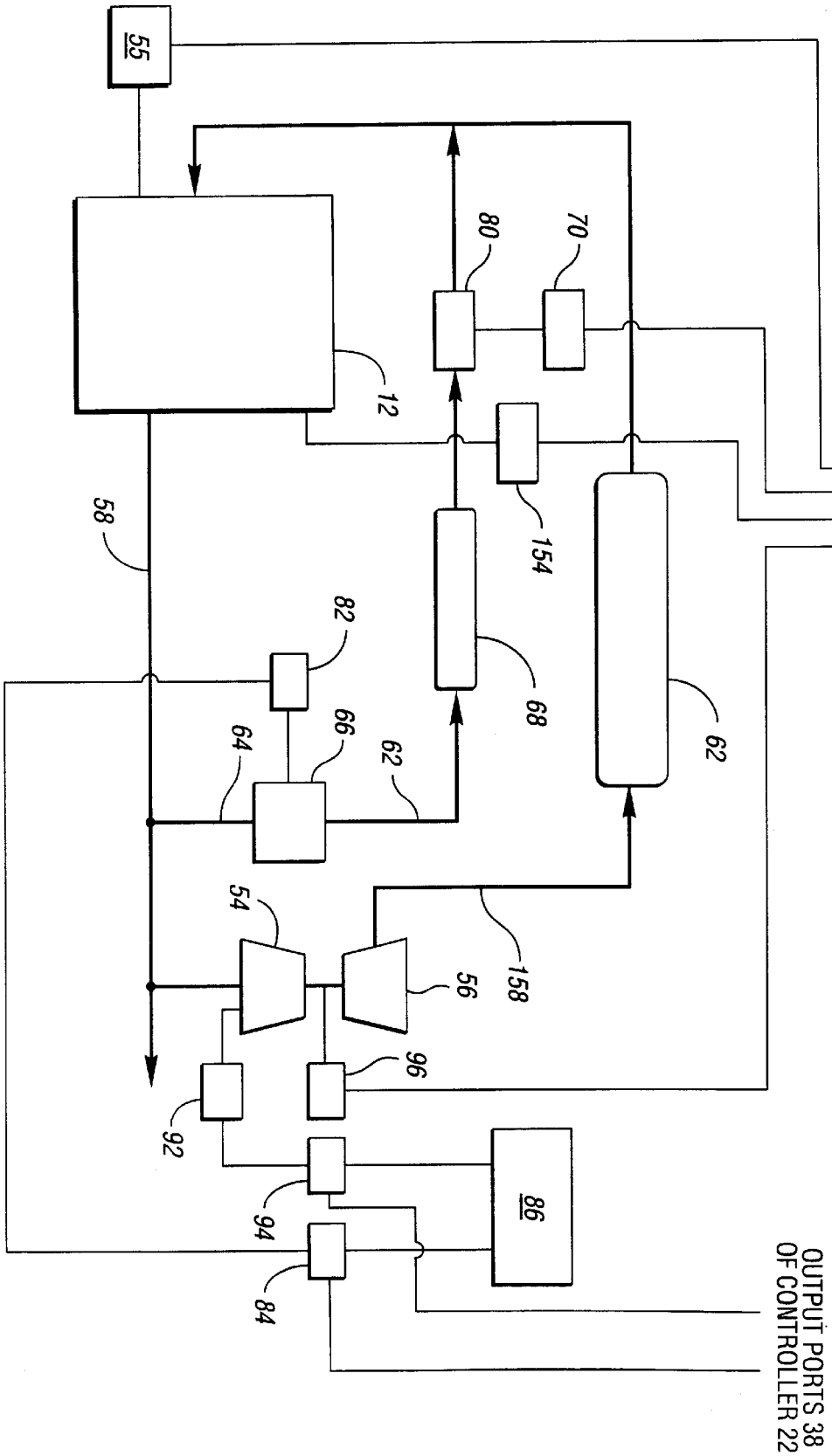
FIG. 2 is a more detailed schematic diagram illustrating the recirculated exhaust gas system in accordance with the present invention.

FIG. 2 schematically illustrates in greater detail a recirculated exhaust gas flow system having control logic which compensates for sensor error in accordance with the present invention. EGR 66 is controlled via an actuator 82. In one embodiment, this actuator is a pneumatic actuator which is activated by a solenoid valve 84, connected to outputs from controller 22 to receive suitable control signals to regulate pressure from a compressed air supply 86 to pneumatically activate and deactivate EGR valve actuator 82 to position EGR valve 66 as desired. In one embodiment, EGR valve 66 is controlled to move between a closed position (i.e., none of the exhaust gas is diverted for recirculation into the charge air), and a single, factory-selected open position which diverts a portion of the gas for recirculation. Alternatively, EGR valve 66 may be provided with a plurality of discrete controllable vane positions, or an infinitely positionable vane which may be controlled as described herein to vary the mix of recirculated exhaust gas and charged air. The remainder of the exhaust gas is supplied via line 58 to drive turbine 54 of VGT 52 as stated above. VGT 52 is typically also controlled by an actuator, such as pneumatic actuator 92 which, in one embodiment is activated by PVH valve 94 controlled by input signals from controller 22. A turbocharger speed sensor 96 may be connected to VGT 56 to provide VGT speed information to controller 22.

With continuing reference to FIG. 2, one embodiment of the present invention employs an obstruction, such as obstructor 80 in the recirculated exhaust gas line 162. In this embodiment, the pressure sensor 70 is a commercially available differential pressure sensor, which includes two pressure measurement taps mounted to sense the pressure downstream and upstream, respectively, of the obstructor 80 which conventionally is a thin walled plate which defines a circular orifice conventionally used in the industry mounted within line 162 to obstruct EGR flow and, thereby, create a pressure differential upstream and downstream of the plate. A temperature sensor 154 is mounted in recirculated exhaust line 162 to provide exhaust gas temperature data to controller 22. The control logic of this embodiment of the present invention typically utilizes the differential pressure data provided by differential pressure sensor 70, the exhaust gas temperature data provided by temperature sensor 154, and intake manifold pressure data provided by pressure sensor 54 to determine EGR flow.

In one embodiment, the EGR flow is determined by the control logic utilizing the output, e.g. voltage or output counts, from differential pressure sensor 70 as described in detail in U.S. Provisional Application No. 06/193,837, the disclosure of which is hereby incorporated by reference. For example, the pressure is calibrated linearly between 0.5 and 4.5 volts for pressure ranging from 0 to 5 pounds per square inch. The correlation, in kPa to voltage is shown as the following equation:

$$\text{Differential Pressure Drop, kPa} = a*(\text{Sensor Voltage}) - b \quad (1)$$

where a and b are constants which are calibrated by flow bench trials.

The differential pressure drop is related to EGR flow rate through the following correlation:

$$\text{EGR Flow Rate (kg/min)} - (\text{Density/Density Correction})^{a}*b*(\text{Differential Pressure Drop, kPa})^{c} \quad (2)$$

where the Density Correction, a, b, and c are also constants which may be calibrated for a particular obstructor geometry by flow bench trials.

The EGR gas density is calculated from the EGR temperature, provided by a sensor and intake manifold pressure, provided by another sensor, according to the following equation:

$$\text{Density} = (\text{Intake Pressure,kPa})/(\text{EGR Temperature, K}*0.2876) \quad (3)$$

With implementation of the system and method provided by the present invention, it has been found that most commercially available differential pressure sensors may be implemented in the EGR flow system to determine substantially optimal EGR flow. Moreover, it has been further found that differences in calibrations between sensors of the same or different model and manufacturer may be compensated during ignition and engine idle, eliminating sensor pretesting and added maintenance to a vehicle for sensor recalibrations. As shown in FIG. 2, a temperature sensor 55 is mounted to engine 12 adjacent the radiator (not shown) to provide coolant temperature data to controller 22. The control logic of this embodiment of the present invention (illustrated in FIG. 3) utilizes the differential pressure data provided by the differential pressure sensor 70 and the coolant temperature data provided by temperature sensor 55 to compensate for differential pressure sensor error.

Figure 3:
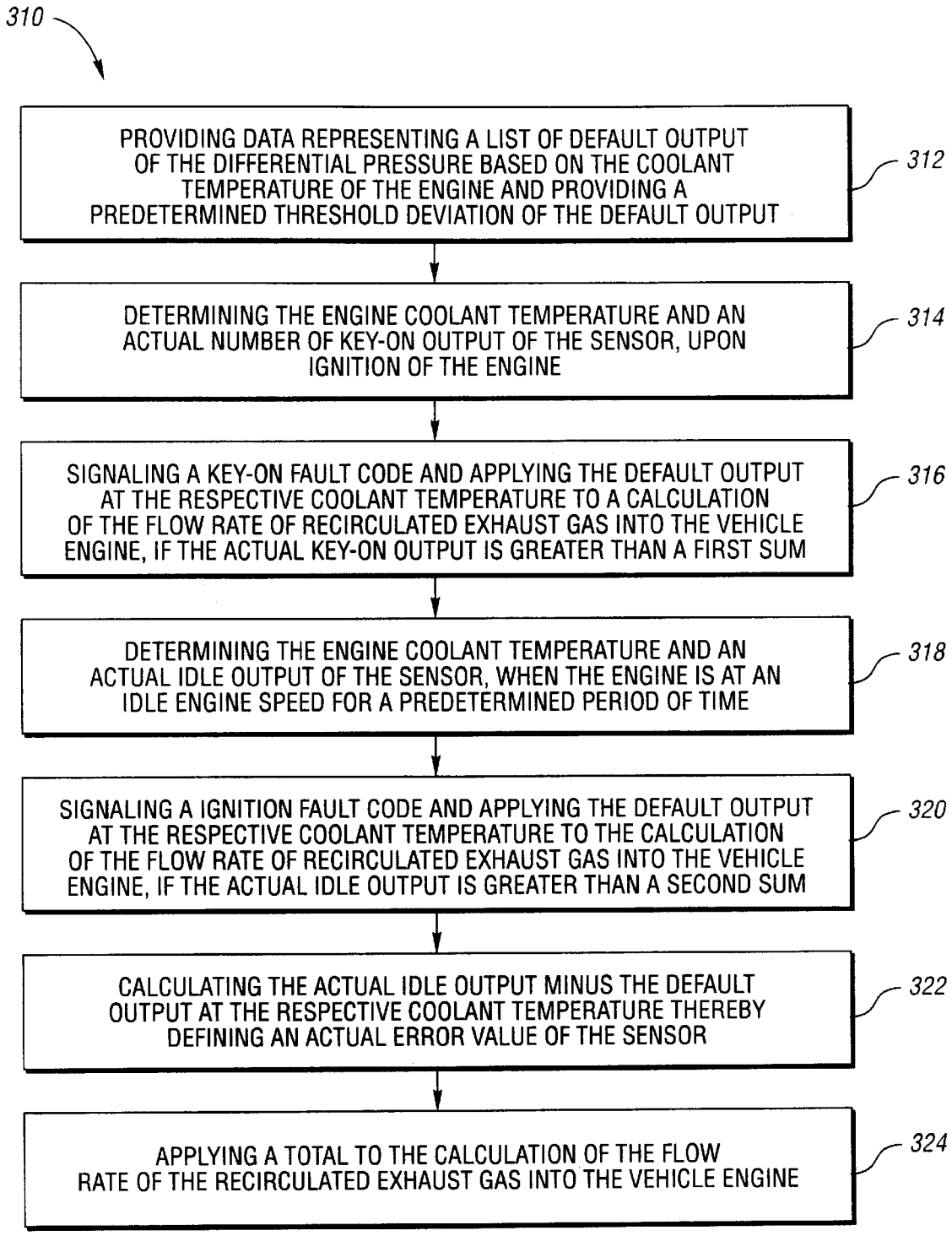
FIG. 3 is a flow chart illustrating one method of control logic of a controller for compensating sensor error of a differential pressure sensor on an exhaust gas recirculation passage for a calculation of a flow rate of recirculated exhaust gas into a vehicle engine.
Figures 4, 5:
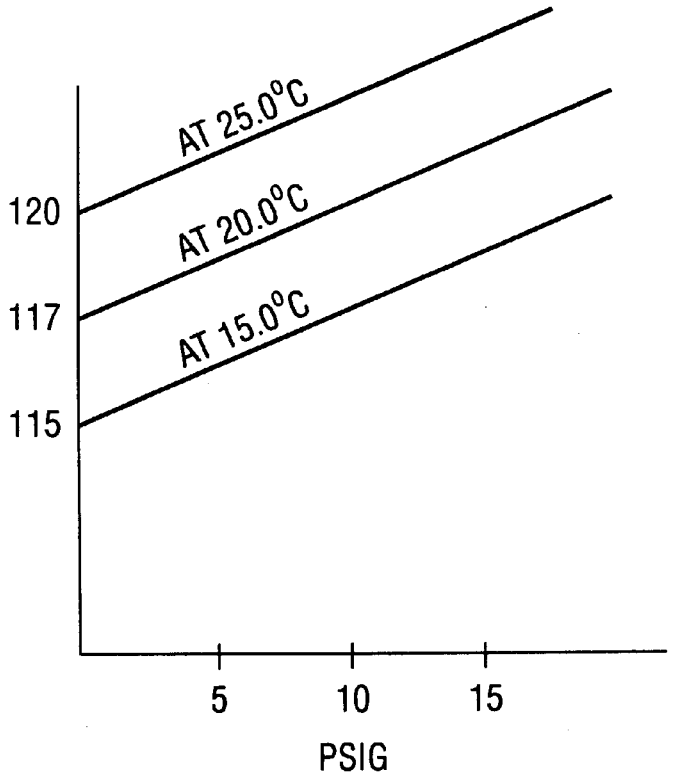
FIG. 4 is a table depicting default output of a predetermined differential pressure sensor in accordance with the present invention.
FIG. 5 is a graph depicting data of FIG. 4.

FIG. 3 illustrates one method of the control logic of controller 22 for compensating sensor error of a differential pressure sensor on an exhaust gas recirculating passage for a calculation of a flow rate of recirculated exhaust gas into a vehicle engine. Controller 22 is provided with data representing default output of the differential pressure sensor based on the coolant temperature of the engine and is provided a predetermined threshold deviation of the default output in box 312. As shown in FIGS. 4 and 5, one embodiment may include the data being a list of default output, e.g. counts, of the differential pressure sensor of various coolant temperatures of the engine. FIG. 4 illustrates a table of default output of a predetermined differential pressure sensor based on coolant temperatures of the engine. The data shown in FIG. 4 is graphed in FIG. 5. FIG. 5 illustrates a graph of output counts from a differential sensor versus pounds per square inch gauge at various temperatures. It should be noted that the slopes of each line at different temperatures are characteristically substantially similar. As shown, at zero pounds per square inch gauge and at varying temperatures, the offset in counts from the sensor varies accordingly. In this embodiment controller 22 is also provided a predetermined threshold deviation of five counts; however, threshold deviation may vary as desired.

Controller 22 then determines the engine coolant temperature via temperature sensor 55 and determines an actual key-on output of the sensor via pressure sensor 70 in box 314, upon ignition of the engine. The output from sensor 70 may be any suitable output, for example, counts or volts. In this embodiment, sensor 70 provides output counts as output. In box 316, if the actual key-on output is greater than a first sum, then controller 22 signals a key-on fault code and applies the default count output (FIGS. 4 & 5) at the respective coolant temperature to a calculation of the flow rate of recirculated exhaust gas into the vehicle engine. In this embodiment, the first sum is defined by the default count at the respective coolant temperature plus the predetermined threshold deviation. In this embodiment, the predetermined threshold deviation is five counts. Thus, for example, if at 15.0° Celsius pressure sensor 70 provides an output of 121 counts, then controller 22 signals the key-on fault code and applies the default values represented by 115.00 counts in the calculations of the EGR flow rate. However, if the actual key-on output is less than the first sum, then control 22 determines the engine coolants temperature and an actual idle output of the sensor in box 318, when the engine is at an idle engine speed for a predetermined time. In this embodiment, the predetermined time may be between 1–15 seconds. In box 320, if the actual idle output of the sensor is greater than a second sum, then controller 22 signals and ignition fault code and applies the default count output (FIGS. 4 and 5) at the respective coolant temperature to the calculation of the flow rate of recirculated exhaust gas into the vehicle engine. In this embodiment, the second sum is defined by the respective default output count at the respective temperature plus the predetermined threshold deviation which is 5 counts. Thus for example, if at 15 degrees Celsius pressure sensor 70 provides an output of 125 counts, then controller 22 signals the ignition fault code and applies the default values represented by 115.00 counts in the calculations of the EGR flow rate. However, if the actual idle output is less than the second sum, then control 22 calculates an actual error value of sensor 70 based on observing the actual idle output and engine coolant temperature in box 322. In this embodiment, the actual error value is defined by the actual number of idle output counts minus the default output counts at the respective coolant temperature.

Controller 22 then utilizes the actual error value in calculating the flow rate of the recirculated exhaust gas into the vehicle engine at off-idle conditions in box 324. For example, summing the default offset count (FIGS. 4 and 5) at the respective coolant temperature and the actual error value of the sensor may determine a total or an offset value to be used. Then, the total may be applied to calculations of the flow rate of the recirculated exhaust gas into the vehicle engine.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A system for compensating sensor error of a differential pressure sensor on an exhaust gas recirculation passage for use in a calculation of a flow rate of recirculated exhaust gas into a vehicle engine, the system comprising:

a mechanism for providing data representing default output of the differential pressure sensor based on the coolant temperature of the engine and providing a predetermined threshold deviation of the default output;

a mechanism for determining the engine coolant temperature and an actual idle output of the sensor, when the engine is at an idle engine speed for a predetermined period of time;

a mechanism for calculating an actual error value of the sensor based on observing the actual idle output of engine coolant temperature; and a mechanism for utilizing the actual error value in calculating the flow rate of the recirculated exhaust gas into the vehicle engine at off-idle conditions.

2. A system for compensating sensor error of a differential pressure sensor on an exhaust gas recirculation passage for use in a calculation of a flow rate of recirculated exhaust gas into a vehicle engine, the system comprising:

an exhaust gas recirculation valve mounted in the engine exhaust line for controllably diverting a selected portion of the exhaust gas for mixture with intake air;

a temperature sensor mounted in the flow path of the engine coolant;

an obstruction in the flow path of the recirculated exhaust gas;

a differential pressure sensor including a first pressure tap located for sensing the pressure of the recirculated exhaust gas upstream of the obstruction, and a second pressure tap located for sensing the pressure of the recirculated exhaust gas downstream of the obstruction, the differential pressure sensor having outputs indicative of current differential pressure across the obstruction; and control logic for determining flow rate of the recirculated exhaust gas, the control logic having data representing a list of default output of the differential pressure sensor based on the coolant temperature of the engine and having a predetermined threshold deviation of the default output of the differential pressure sensor.

3. The method of claim 2 wherein the list of default output ranges between 100 and 150 counts at a coolant temperature between 5 and 100 degrees Celsius, the temperatures ranging between predetermined intervals.

4. A method of compensating sensor error of a differential pressure sensor on an exhaust gas recirculation passage for a calculation of a flow rate of recirculated exhaust gas into a vehicle engine, the method comprising:

providing data representing a list of default output of the differential pressure sensor based on the coolant temperature of the engine and providing a predetermined threshold deviation of the default output;

determining the engine coolant temperature and an actual number of key-on output of the sensor, upon ignition of the engine;

signaling a key-on fault code and applying the default output at the respective coolant temperature to a calculation of the flow rate of recirculated exhaust gas into the vehicle engine, if the actual key-on output is greater than a first sum defined by the default output at the respective temperature plus the predetermined threshold deviation;

determining the engine coolant temperature and an actual idle output of the sensor, when the engine is at an idle engine speed for a predetermined period of time;

signaling an ignition fault code and applying the default output at the respective coolant temperature to the calculation of the flow rate of the recirculated exhaust gas into the vehicle engine, if the actual idle output is greater than a second sum defined by the respective default output at the respective temperature plus the predetermined threshold deviation;

calculating the actual idle output minus the default output at the respective coolant temperature thereby defining an actual error value of the sensor; and applying a total to the calculation of the flow rate of the recirculated exhaust gas into the vehicle engine, the total defined by the actual error value plus the default output at the respective coolant temperature.

5. The method of claim 4 wherein the predetermined threshold deviation of the default output is 5 counts.

6. The method of claim 4 wherein the predetermined period of time is 1–15 seconds.

7. The method of claim 4 wherein the list of default output range between 100 and 1050 counts at a coolant temperature between 5 and 100 degrees Celsius, the temperatures ranging between predetermined intervals.

8. The method of claim 7 wherein the temperature range is in 5 degree intervals.

9. The method of claim 8 wherein the counts are indicative of differential pressure between 0.0 to 5.0 pounds per square inch across as exhaust gas recirculation passage.

10. A method of compensating sensor error of a differential pressure sensor on an exhaust gas recirculation passage for a recirculation of a flow rate of recirculated exhaust gas into a vehicle engine, the method comprising;

providing data representing default output of the differential pressure sensor based on the coolant temperature of the engine and providing a predetermined threshold deviation of the default output;

determining the engine coolant temperature and an actual idle output of the sensor, when the engine is at an idle engine speed for a predetermined period of time;

calculating an actual error value of the sensor based on observing the actual idle output and engine coolant temperature; and utilizing the actual error value in calculating the flow rate of the recirculated exhaust gas into the vehicle engine at off-idle conditions.

11. The method of claim 10 wherein the predetermined period of time is one to fifteen seconds.

12. The method of claim 10 wherein the predetermined threshold deviation of the default output is 5 counts.

13. The method of claim 10 wherein the predetermined period of time is 1–15 seconds.

14. The method of claim 10 further comprising:

determining the engine coolant temperature and an actual key-on output of the sensor, upon ignition of the engine;

signaling a key-on fault code and applying the default output at the respective coolant temperature to a calculation of the flow rate of recirculated exhaust gas into the vehicle engine, if the actual key-on output is greater than a first sum defined by the default output at the respective temperature plus the predetermined threshold deviation.

15. The method of claim 14 further comprising signaling an ignition fault code and applying the default output at the respective coolant temperature to the calculation of the flow rate of the recirculated exhaust gas into the vehicle engine, if the actual idle output is greater than a second sum defined by the respective default output at the respective temperature plus the predetermined threshold deviation.

16. The method of claim 10 wherein the default output ranges between 100 and 150 output counts at a coolant temperature between 5 and 100 degrees Celsius, the temperatures ranging between predetermined intervals.

17. The method of claim 16 wherein the temperature range is in 5 degree intervals.

18. The method of claim 16 wherein the output counts are indicative of differential pressure of between 0.0 to 5.0 pounds per square inch across the exhaust gas recirculation passage.

19. The method of claim 16 wherein the predetermined threshold deviation of the default output is 5 counts.

20. The method of claim 16 wherein the temperature range is in 5 degree intervals.

21. The method of claim 16 wherein the counts are indicative of differential pressure between 0.0 to 5.0 pounds per square inch across the exhaust gas recirculation passage.

* * * * *

UNITED STATES PATENT AND TRADEMARK OFFICE

CERTIFICATE OF CORRECTION

PATENT NO. : 6,363,922 B1 
DATED : April 2, 2002
INVENTOR(S) : Martin Anthony Romzek and Richard Marcis It is certified that error appears in the above-identified patent and that said Letters Patent is hereby corrected as shown below:

Title page,
Please insert the assignee -- Detroit Diesel Corporation, Detroit, Michigan --.

Signed and Sealed this

Third Day of September, 2002

*Attest:*

*Attesting Officer*

JAMES E. ROGAN
*Director of the United States Patent and Trademark Office*